US005094659A

United States Patent [19]

Schwartz

[11] Patent Number: 5,094,659

[45] Date of Patent: Mar. 10, 1992

[54] METHOD AND APPARATUS FOR DISPENSING DRINKING STRAWS

[76] Inventor: William K. Schwartz, 1160 Fifth Ave., Apt. 603, New York, N.Y. 10029-6928

[21] Appl. No.: 558,572

[22] Filed: Jul. 27, 1990

[51] Int. Cl.[5] ..... B31B 1/78
[52] U.S. Cl. ..... 493/309; 493/288
[58] Field of Search ..... 493/255, 258, 288, 309

[56] References Cited

U.S. PATENT DOCUMENTS

| | | | |
|---|---|---|---|
| 1,252,235 | 1/1918 | Carper | 493/288 |
| 1,680,341 | 8/1928 | Rosenthal | 239/33 |
| 2,128,564 | 8/1938 | Schoen et al. | 493/288 |
| 3,203,325 | 8/1965 | Davis et al. | 493/288 |
| 3,780,944 | 12/1973 | Zubalik | 239/33 |
| 4,230,030 | 10/1980 | Hanson et al. | 493/255 |
| 4,934,994 | 6/1990 | Yokoyama | 493/309 |

FOREIGN PATENT DOCUMENTS

| | | | |
|---|---|---|---|
| 0774970 | 10/1980 | U.S.S.R. | 493/288 |
| 775726 | 5/1957 | United Kingdom | 493/309 |

*Primary Examiner*—William E. Terrell
*Attorney, Agent, or Firm*—Sprung Horn Kramer & Woods

[57] ABSTRACT

Drinking straws are dispensed by providing an endless, substantially flattened flexible tube having a free end, cutting the free end of the tube to a desired length and opening the tube at its free end into a hollow tube. A refill cartridge is provided for this dispensing method which includes a substantially endless, substantially flattened flexible tube wound in substantially spiral form. The cartridge may comprise a spindle disposed at the center of the spirally wound tube, whereby the tube may be unwound from the outside of the spiral form, or the cartridge may include a cylindrical sleeve disposed around the outside circumference of the spirally wound tube, whereby the tube may be unwound from the inside of the spiral form.

14 Claims, 10 Drawing Sheets

METHOD AND APPARATUS FOR DISPENSING DRINKING STRAWS

BACKGROUND OF THE INVENTION

The present invention relates to a method and apparatus for dispensing drinking straws of various types. In addition, the invention relates to a drinking straw refill cartridge for use with the aforementioned method and apparatus.

The drinking straw has become a familiar staple item in households and fast food restaurants throughout the world. Originally made from coated paper, drinking straws are now normally made of thin, flexible plastic. The plastic straws are manufactured by extruding an endless tube and then cutting the tube to a convenient (e.g., 7 ¾ inch) length. The straws are then either loaded directly into boxes or first individually wrapped in paper sleeves before packing for shipment.

In some cases, straws have been modified, from this basic tubular structure, to permit special packaging arrangements. The U.S. Pat. No. 1,630,341 to Rosenthal discloses a flattened straw, cut to the usual 7 ¾ inch length, which is either rolled into a spiral form or folded back and forth a large number of times to reduce its size. The resulting spirally wound or folded straw is then encapsulated in a bottle cap or other small package and attached to a bottle, can or carton.

The U.S. Pat. No. 3,780,944 also discloses a flattened drinking straw. During manufacture, a conventional round plastic straw is compacted and embossed between a pair of gears to facilitate its being folded a convenient number of times and fixed to a bottle, can or carton.

In the arrangements taught in both patents, an individual straw is dispensed with each bottle, can or carton. While this may be convenient for the consumer, it is an expensive solution to the straw dispensing problem.

More conventionally, in order to provide and dispense straws for use with soda cans or cups, for example, a plurality of tubular straws, cut to length, are supplied in a suitable container and dispensed, one by one, from the container by a suitable mechanical device. This method of dispensing straws is wasteful of space and requires frequent restocking of the dispensing device. Also, this arrangement does not permit straws of different length to be dispensed from a single device. Furthermore, since the volume occupied by a straw consists mostly of empty, unused space, this conventional method of dispensing straws creates inefficiencies in storage and shipping. Finally, this prior method of dispensing straws is less than fully sanitary since the straws are required to be handled by several persons before they are dispensed to the user.

SUMMARY OF THE INVENTION

It is a principal object of the present invention to provide an apparatus for dispensing drinking straws which requires refilling at less frequent intervals than the conventional devices known in the art.

It is another object of the present invention to provide a method and apparatus for dispensing drinking straws which facilitates use of a compact refill cartridge which contains material for a large number of drinking straws.

It is a further object of the present invention to provide a method and apparatus for dispensing drinking straws which permits the selection of straws of different desired lengths.

It is a further object of the present invention to provide a refill cartridge for a drinking straw dispensing device which holds straw material in an especially compact form for shipping, storing and dispensing.

These objects, as well as further objects which will become apparent from the discussion that follows, are achieved, in accordance with the present invention, by:

(a) providing a substantially endless, substantially flattened flexible tube having a free end;
(b) cutting the free end of the tube to a desired length;
(c) opening the tube at the free end into a hollow tube; and
(d) repeating steps (b) and (c) any desired number of times and in any desired order to form hollow straws of any desired length.

The apparatus for carrying out these steps includes a refill cartridge containing the flattened flexible tube wound in substantially spiral form. The apparatus also includes a device for cutting the free end of the tube to length and a device for opening the tube at its free end into a hollow tube to form a hollow straw.

The refill cartridge for use with the method and apparatus described above thus comprises the flattened, flexible tube wound in substantially spiral form. This cartridge may be self supporting, if tightly wound and held together with tape for transport, or it may be wound around a spindle or within a cylindrical sleeve. If wound on a spindle, the spindle preferably comprises a central cylindrical member, for supporting the inside of the spirally wound tube, and two annular flat members for supporting the sides of the spirally wound tube. In this case, the tube is unwound from the outside of the spiral form.

Alternatively, a cylindrical sleeve may be disposed around the outside circumference of the spirally wound tube providing a rigid external support for the wound tube, and two annular flat members may be provided on either side of the spirally wound tube for lateral support. In this case, the tube may be unwound from the inside of the spiral form.

When the flattened tube is unwound from the spiral form, it has a tendency to retain is wound curvature. According to a preferred embodiment of the present invention, the tube is passed around a roller which gives it a "reverse twist", thereby straightening the tube before it is cut to length.

When opening the tube at its free end to form a hollow straw, the tube may be given any desired cross sectional shape. For example, the straw may be opened into a conventional circular shape, it may be opened into a square shape, or it may be opened into a moon shape for use as a swizzle stick.

It has been found that flattened tubes made of plastic may be opened to form hollow straws in virtually any desired cross sectional shape. However, any known material may be used for the tube provided that the material is flexible and has a tendency to return to its original shape after deformation, i.e., it has a tendency to return to its original manufactured shape after it has been flattened.

The principal advantage of the present invention is a substantial reduction of the space requirements for the flattened flexible tube, as compared with conventional straws in their hollow, empty form. The space required by the refill cartridge according to the present invention is less than one fifth of that required to provide an equal number of conventional straws.

When wound in spiral form, the flattened flexible tube can be conveniently packed and shipped in boxes, in the same manner as rolls of adding machine tape. The total length of a tube $L_R$ on a spiral roll may be determined from the following formula:

Number of Turns × Mean diameter × $\pi$, or $$\frac{OR - IR}{T} \times \left( \frac{OR - IR}{2} + IR \right) \times 2\pi,$$

where OR is the outer radius of the roll, IR is the inner radius of the roll and T is the thickness of the flattened tube.

The number of straws obtainable from a refill cartridge is thus $L_R/L_S$, where $L_S$ is the length of each straw.

Another principal advantage of the present invention is the ability of the user to reduce the length of each straw to a minimum to meet specific requirements. Thus, for example, in a fast food restaurant one length of straw is normally provided for all sizes of drinking cups: small, medium and large. With the present invention, it is possible to dispense short straws for small cups, medium length straws for medium sized cups and long straws for large cups, thereby affording a saving in the total length of straw tube material used.

Other objects and advantages of the present invention will become apparent from the following description of the preferred embodiments, taken in conjunction with the accompanying drawings.

DESCRIPTION OF THE PREFERRED EMBODIMENTS

Figure 1:
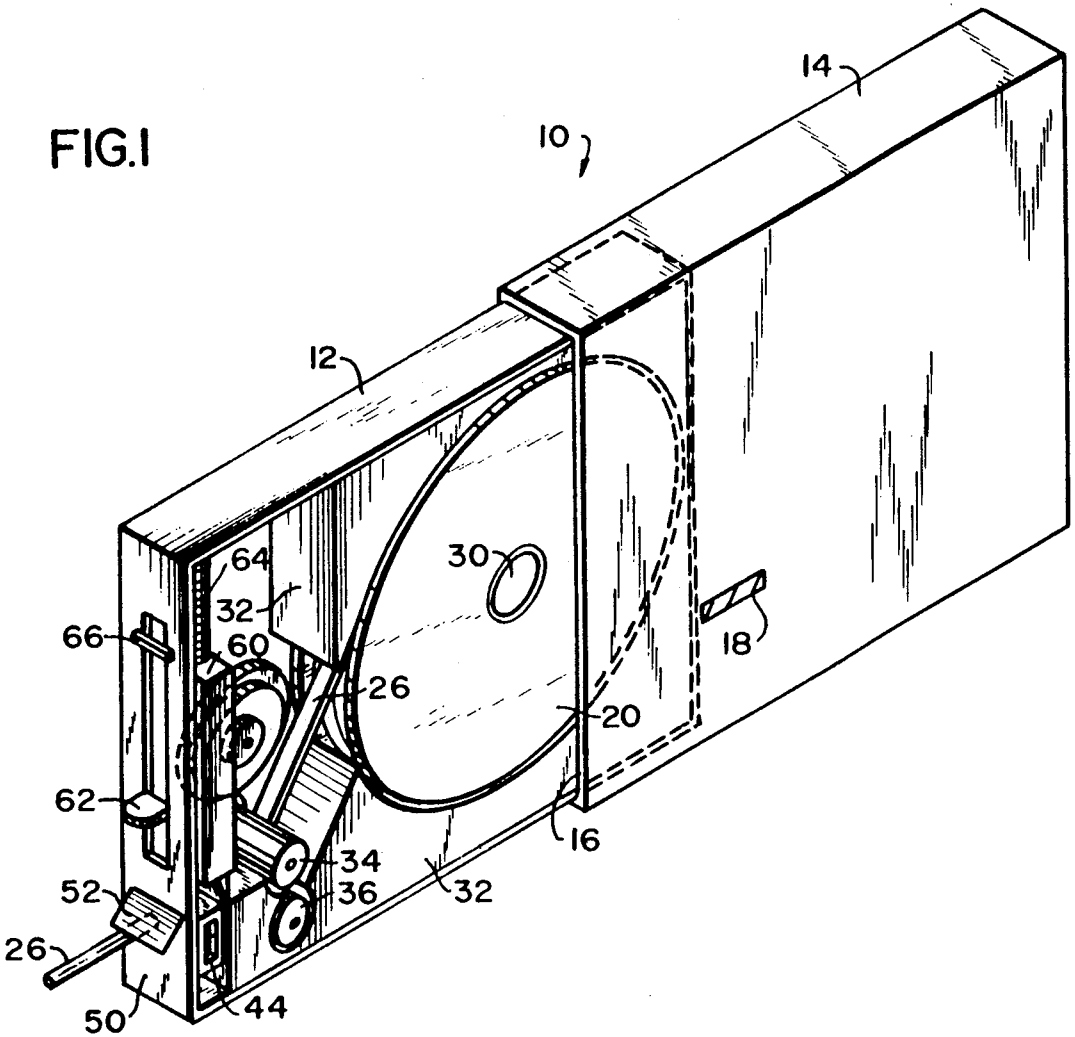
FIG. 1 is a perspective view of a drinking straw dispenser according to one preferred embodiment of the present invention.

The preferred embodiments of the present invention will now be described with reference to FIGS. 1–4 of the drawings. Identical elements in the various figures are designated with the same reference numerals.

Figure 2:
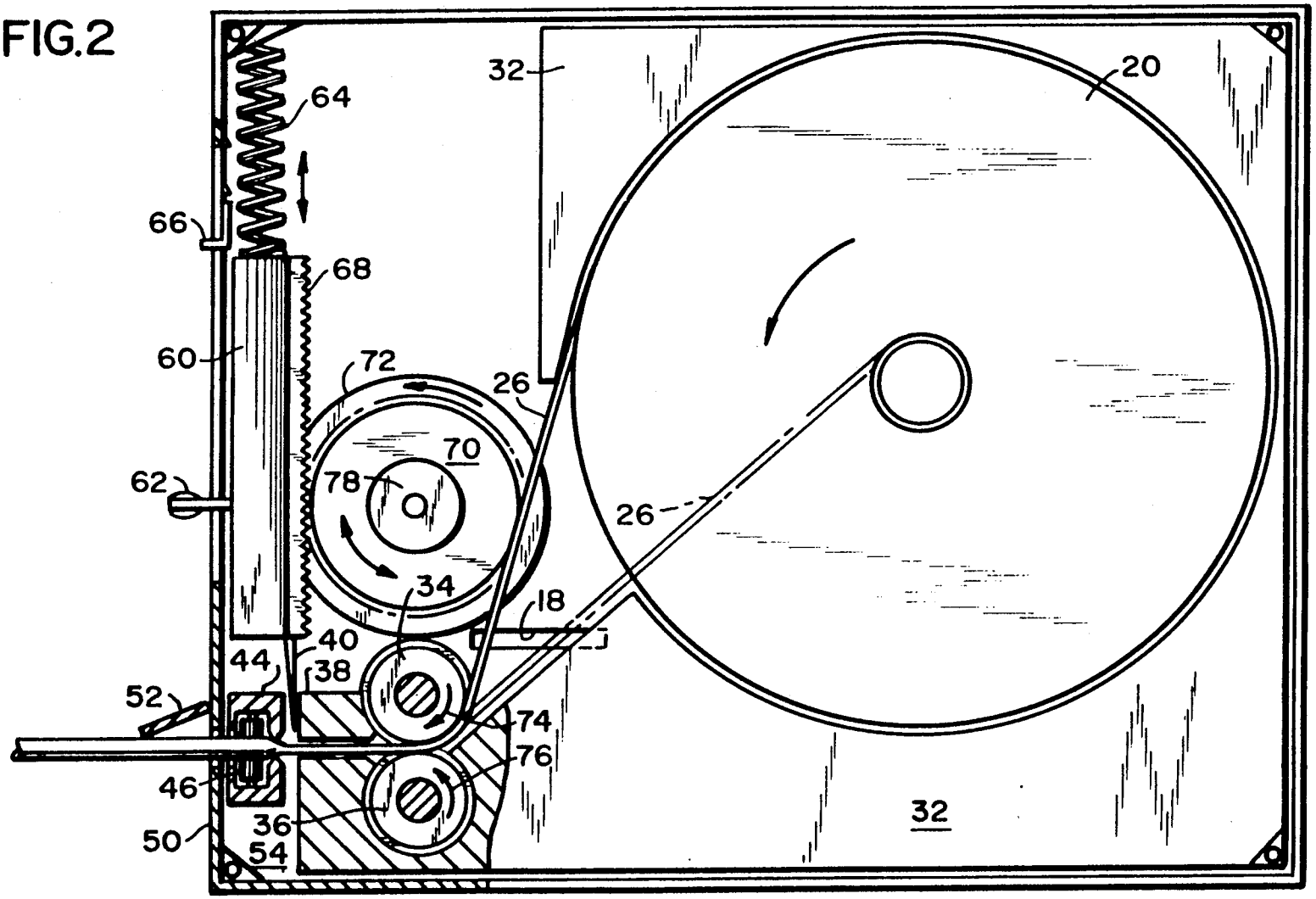
FIG. 2 is a side view of the drinking straw dispenser of FIG. 1 with the casing removed.
Figure 3:
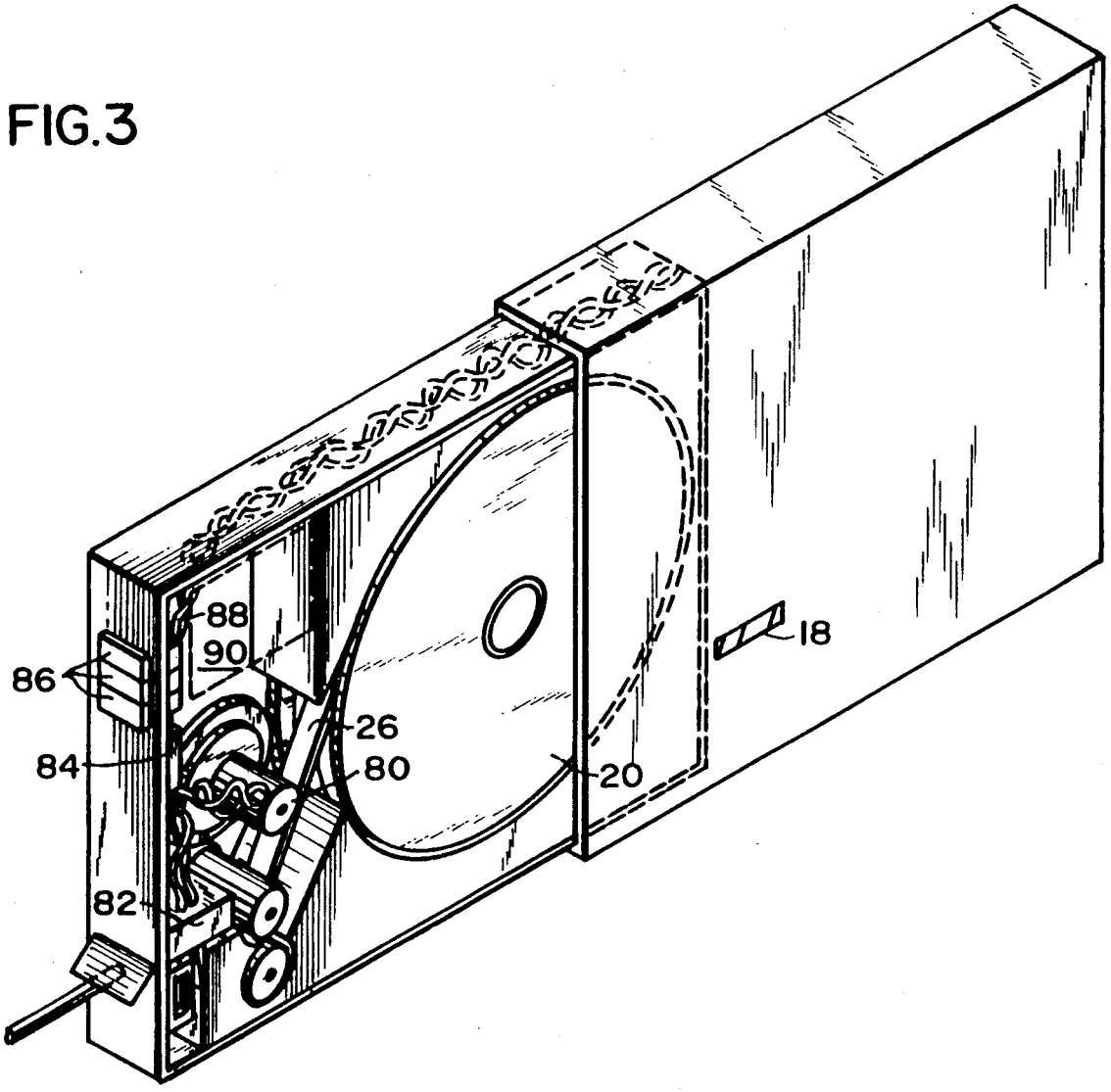
FIG. 3 is a perspective view of a drinking straw dispenser according to another preferred embodiment of the present invention.

FIGS. 1 and 2 illustrate a mechanically actuated straw dispenser, and FIGS. 3 an 4 illustrate an electrically actuated straw dispenser, in accordance with the principals of the present invention. Details of the dispensers shown in FIGS. 1–4 may be seen in FIGS. 5 and 6. The drinking straw refill cartridge employed in the dispensers of FIGS. 1–4 is further illustrated in FIGS. 7A and 7B.

As shown in FIGS. 1–4, the dispensing apparatus 10 comprises a housing or chassis 12 arranged to fit within a rectangular casing or cover 14. The cover 14 is open at one end 16 to permit the insertion of the chassis 12, but otherwise it is enclosed on all sides. A rectangular opening or window 18 is provided on one side to permit the user to see at a glance the condition of fullness of the refill cartridge. Alternatively, other means, such as a mechanical counter, may be used to determine how many straws have been dispensed and warn the user when the refill cartridge needs replacing.

Figure 7A:
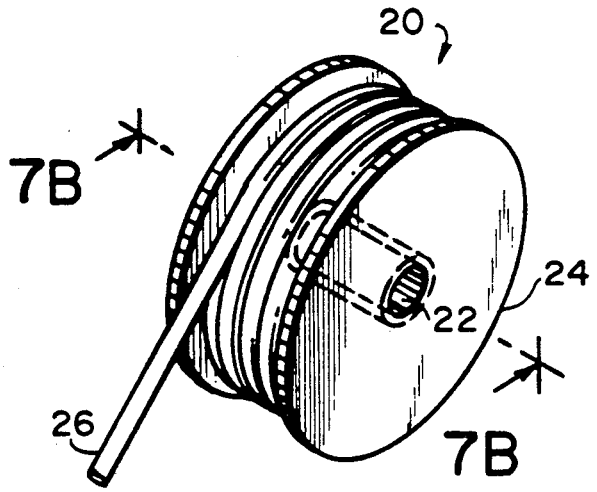
FIGS. 7A and 7B are perspective and cross-sectional views, respectively, of one type of refill cartridge for use with the drinking straw dispensers of FIGS. 1–4.
Figure 7B:
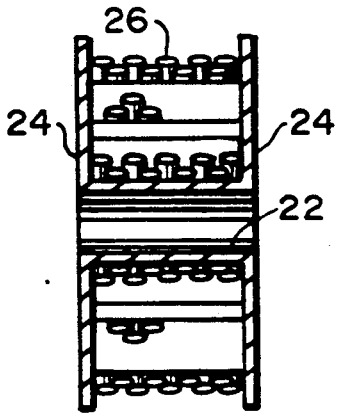

The refill cartridge 20 is preferably designed in the manner shown in FIGS. 7A and 7B. The cartridge comprises a spindle having a central hub 22 and lateral sides 24. Wound on the spindle, in spiral form, is a substantially endless, substantially flattened tube 26 made of plastic, paper or the like. This tube is adapted to be opened into a hollow tube and severed to form a straw by the dispensing apparatus 10.

Returning to FIGS. 1–4, the dispensing apparatus includes an axle stub 30 on which the refill cartridge may be placed for rotation during operation. The refill cartridge may be easily removed and replaced, as desired, by removing the chassis 12 from the cover 14. The axle stub 30 is provided with sufficient tolerance with respect to the internal diameter of the hub 22 to permit the refill cartridge to rotate. If necessary, the axle stub 30 may be provided with outwardly biased braking surfaces to impart resistance to the rotation of the refill cartridge. This prevents the flattened tube 26 from unwinding to a greater extent than is necessary for dispensing this tube as successive straws.

Preferably, the dispensing apparatus includes a guide 32 surrounding the position of the refill cartridge to retain the flattened tube 26 within the cartridge.

The refill cartridge may have the width of a single flattened tube, or it may be as wide as a number of tubes, as shown in FIG. 7B. In the latter case, the tube is preferably spirally wound in layers to facilitate even dispensing of the tube.

As is best seen in FIG. 2, the position of the tube, as it is unwound from the refill cartridge, indicates the degree to which the cartridge is full (or, conversely, empty). This position may be viewed through the window 18.

As the straw is unwound from the cartridge 20, it is drawn between the nip of two geared, synchronized friction rollers 34 and 36 which positively grip the tube and advance it forward by desired lengths. As the tube is passed around the roller 34, the reverse bend applied by the roller tends to straighten the inherent curvature which results from its being wound on the cartridge 20.

The rollers 34 and 36 are supported at both ends to maintain their grip on the tube 26. A cover plate containing axle bearings has been removed in the illustration in FIGS. 1 and 3 for clarity.

After passing between the rollers 34 and 36, the tube is advanced through an alignment guide 38 to the position of a cutting blade 40.

After passing the cutting blade, the tube is advanced through a guide and roller mechanism 44 which comprises two rollers 46 on opposite sides of the flattened tube having their axes transverse to the axis of the tube. The guide and roller mechanism squeezes the tube laterally to cause it to open into a hollow straw. The rollers 46 may be rotatably mounted on fixed axles, or axles which are spring biased so that the rollers remain in parallel but are pressed toward each other. Preferably, the position of at least one axle is made adjustable in the direction of the arrow 48 (FIG. 6) to adapt the straw dispensing apparatus to the particular size and material of the flattened tube.

Finally, the now open, hollow tube is passed through an opening in the front face 50 of the apparatus which is normally covered by a hinged flap 52 or some other closure device, such as a bristle brush. The flap or brush prevents dust and other contaminants from entering the apparatus through the opening 50.

The area 54 immediately below the roller mechanism 44 within the chassis 12 is left open to catch dust or stampings which may fall from the cutting blade 40. This area may be emptied, as desired, by providing another suitable opening (not shown) in the chassis 12.

Figure 4:
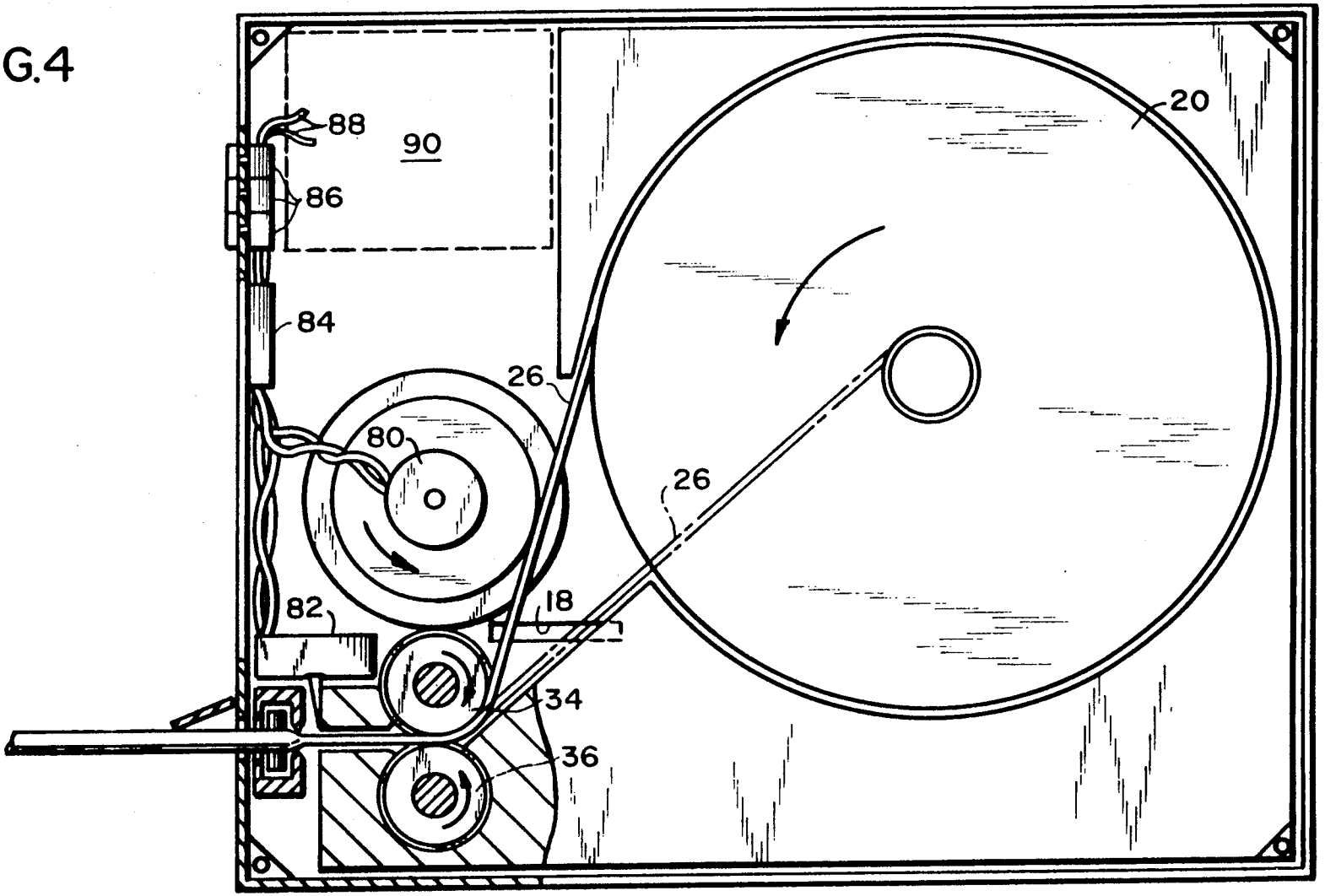
FIG. 4 is a side view of the drinking straw dispenser of FIG. 3 with the casing removed.

What has been described thus far is identical in the embodiments of FIGS. 1 and 2, on one hand, and FIGS. 3 and 4 on the other. The two embodiments differ in their mechanisms for operating the dispensing apparatus.

In the embodiment of FIGS. 1 and 2, a completely mechanical device is provided for hand powered operation of the dispensing apparatus. This device includes a vertically arranged slide 60 having a manual lever 62 extending therefrom through an opening in the housing to permit manual operation. The slide 60 is biased in the upward position by a tension string 64. The end stop position of the slide 60 is adjustable by a multi-position stop 66 to enable the user to select small, medium or large straws (or any length in between).

The cutting blade 40 is rigidly attached to the slide 60 in the position shown and is arranged to slide along the face surface of the alignment guide 38. Alternatively, the blade can be separately mounted in spring loaded fashion and released for cutting by the slide 60.

The rear side of the slide 60 is provided with a gear rack 68 which positively engages a rachet or one way clutch 70. The clutch 70 is rotated in the counter-clockwise and clockwise direction as the slide 60 is moved downward and upward, respectively, by the lever 62. The clutch 70 is coupled to a drive gear 72 in such a way that the drive gear is permitted to move in the counter-clockwise direction only. This drive gear engages the synchronized friction rollers 34 and 36 to cause them to move in the clockwise and counter-clockwise directions, respectively, as indicated by the arrows 74 and 76.

In a preferred embodiment of the dispensing apparatus suitable for use in a fast food restaurant, for example, a second rachet or one way clutch 78 is provided to force completion of the downstroke of the slide 60, thereby severing the tube 26 with the cutting blade 40 before the slide is allowed to return to the top of the stroke. In a simplified version of the apparatus, suitable for home use, for example, this second clutch 78 may be omitted. In this latter case, the slide may be operated any number of times near the top of its stroke so that a straw of any desired extended length may be dispensed before it is severed by the cutting blade.

In the embodiment of FIGS. 3 and 4, actuation of the dispensing device is effected by an electric motor 80 and a separate, electrically actuated cutting mechanism 82. Control of the electric motor 80 and electric cutter 82 is effected by a circuit 84 which may, for example, be a hybrid circuit or even an application specific integrated circuit (ASIC) chip. Operator controlled switches 86, or a continuously variable control device such as a potentiometer, are connected to the circuit 84 to select the length of the straw and initiate the operating cycle. The electric system is powered through wires 88 that are connected to an electric outlet, a rechargeable battery pack 90, or a combination of the two which provides battery back-up.

Dispensing apparatus of the type described is well known in the art for dispensing lengths of flexible sheet material such as paper toweling and the like. Typical apparatus of this type is disclosed, for example, in U.S. Pat. Nos. 4,165,138 and 4,699,304.

Figure 8A:
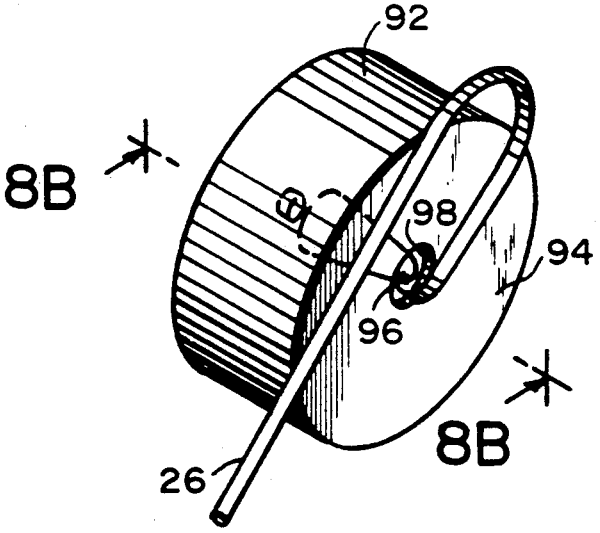
FIGS. 8A and 8B are perspective and cross-sectional views, respectively, of another type of refill cartridge for use with the drinking straw dispensers of FIGS. 1–4.
Figure 8B:
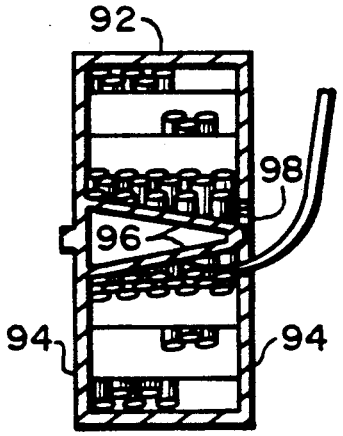

As an alternative to the refill cartridge shown in FIG. 7A and 7B, the refill cartridge may be designed to dispense the flattened tube from the interior of the spiral winding as shown in FIGS. 8A and 8B. In this case, the cartridge casing is formed with a cylindrical outer sleeve 92 and two side members 94. If desired, a central conical spindle 96 may be provided to guide the flattened tube 26 toward a central opening 98.

Figure 9:
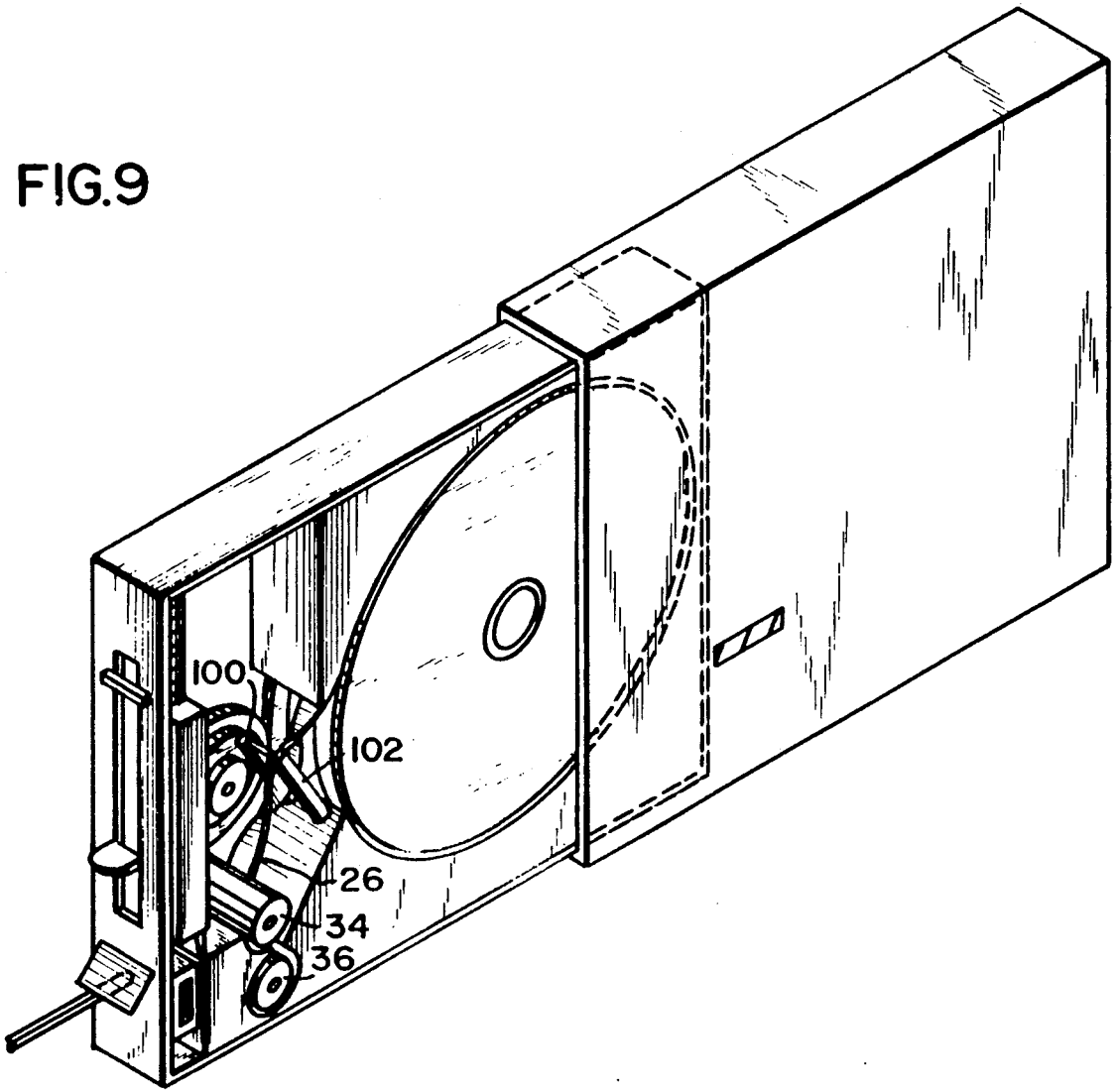
FIG. 9 is a perspective view of a drinking straw dispenser according to another preferred embodiment of the present invention.
Figure 10:
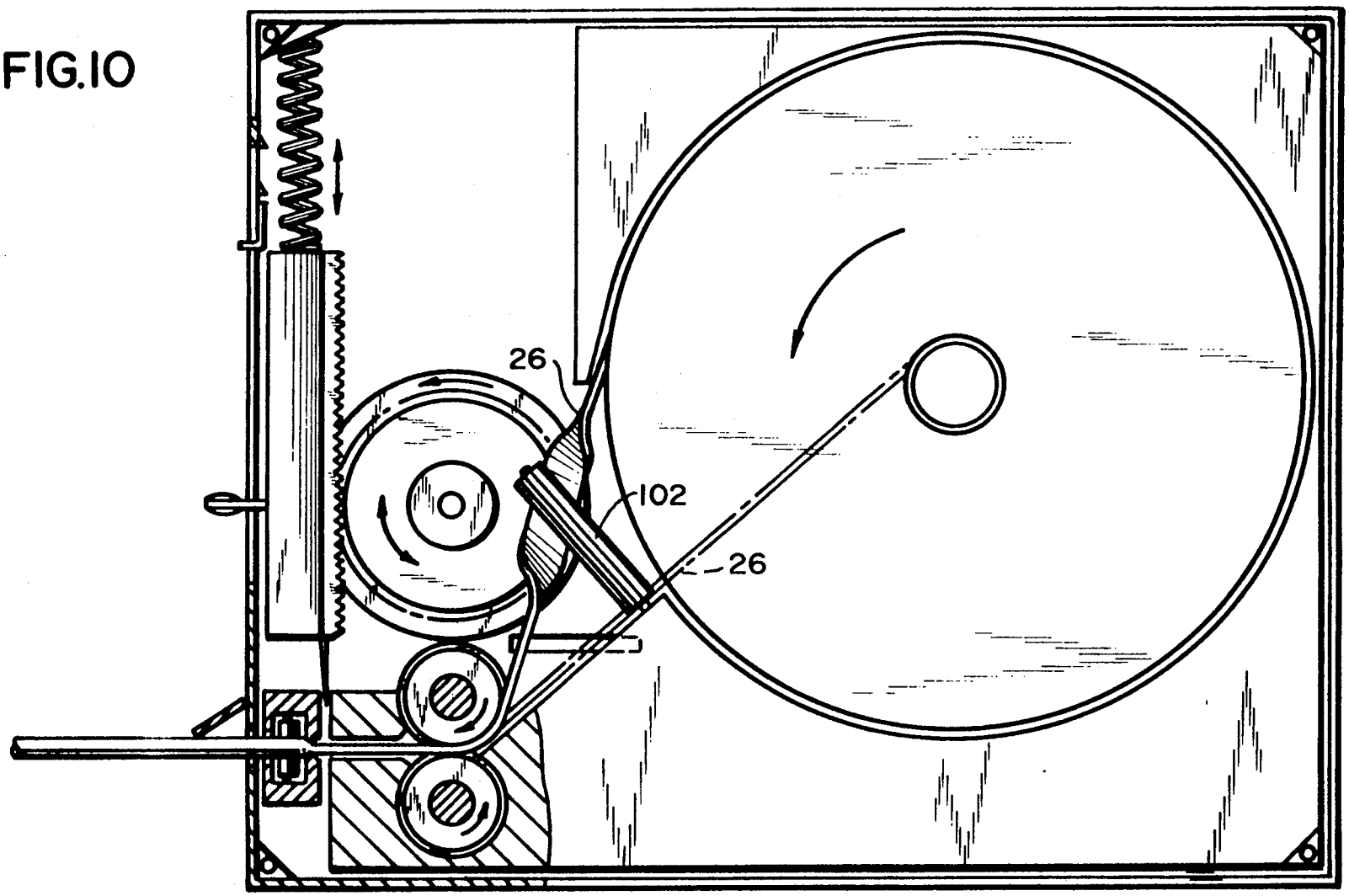
FIG. 10 is a side view of the drinking straw dispenser of FIG. 9 with the casing removed.

FIG. 9 shows a modification of the dispensing device of FIGS. 1 and 2 which permits the use of a wide refill cartridge. In order to maintain the central alignment of the flattened tube 26, the tube is passed through adjacent rollers 100 and 102 which are arranged with their axels substantially transverse to the central axis of the tube. As may be seen in FIG. 9, the rollers 100 and 102 require that the flattened tube change its orientation from substantially horizontal to substantially vertical. Thereafter, the orientation of the tube 26 is changed back to substantially horizontal as it passes between the rollers 34 and 36.

The purpose of this arrangement is to permit the use of a refill cartridge of substantially any width without introducing problems of alignment when the tube is unwound from one side or the other of the cartridge.

Figure 11A:
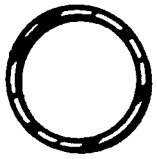
FIG. 11A, 11B and 11C are cross-sectional views of a drinking straw, as may be dispensed by the dispensing apparatus according to the invention.
Figure 11B:
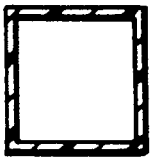
Figure 11C:
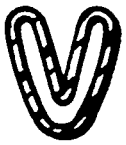

FIGS. 11A, 11B and 11C illustrate the final shape of a tube as being, respectively, circular, square or "moon shaped". The apparatus of FIGS. 1-4 is designed to open the end of the flattened tube to restore this tube to its original, manufactured shape. If the tube was originally manufactured with a circular cross section, the dispensing device will restore the flattened tube to this circular shape as shown in FIG. 11A. If the tube was originally manufactured with a square cross section, the dispensing device will restore the flattened tube to this square shape as shown in FIG. 11B.

It is also possible to crimp the tube at the final stage in the dispensing apparatus to produce a moon shape as shown in FIG. 11C. The tube may thus be used a stirring element or "swizzle stick".

Figure 5:
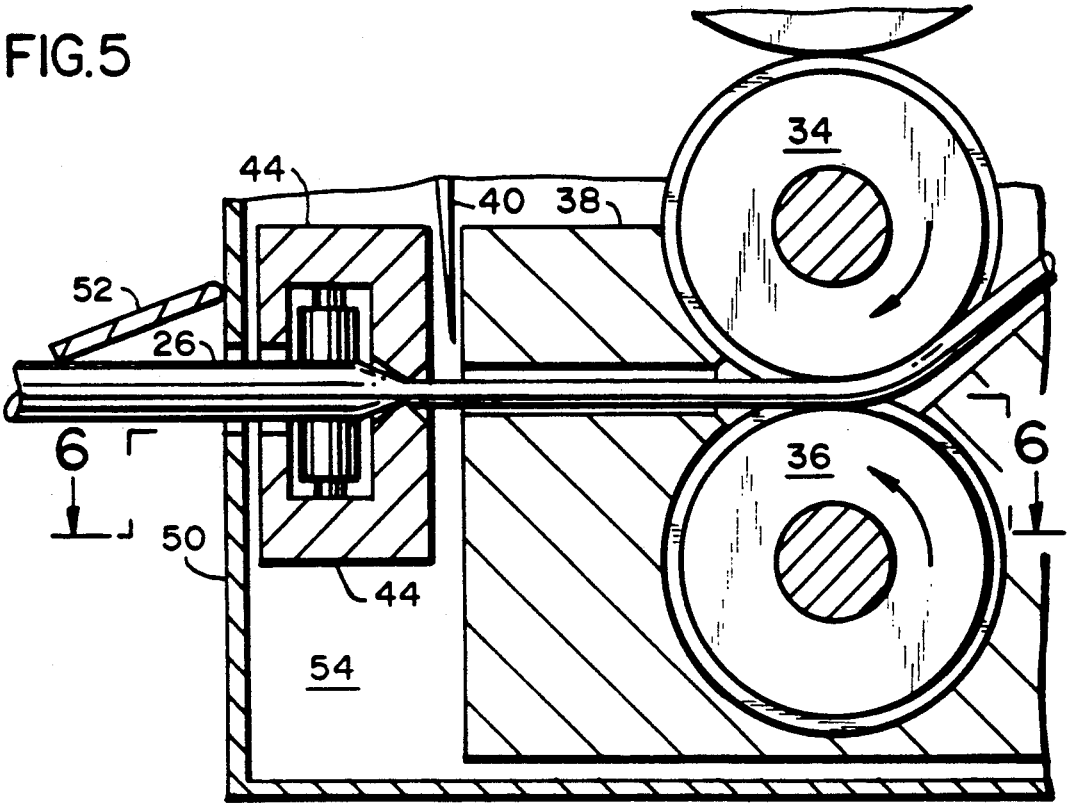
FIG. 5 is a detailed view of a portion of the drinking straw dispensers of FIGS. 1–4.
Figure 6:
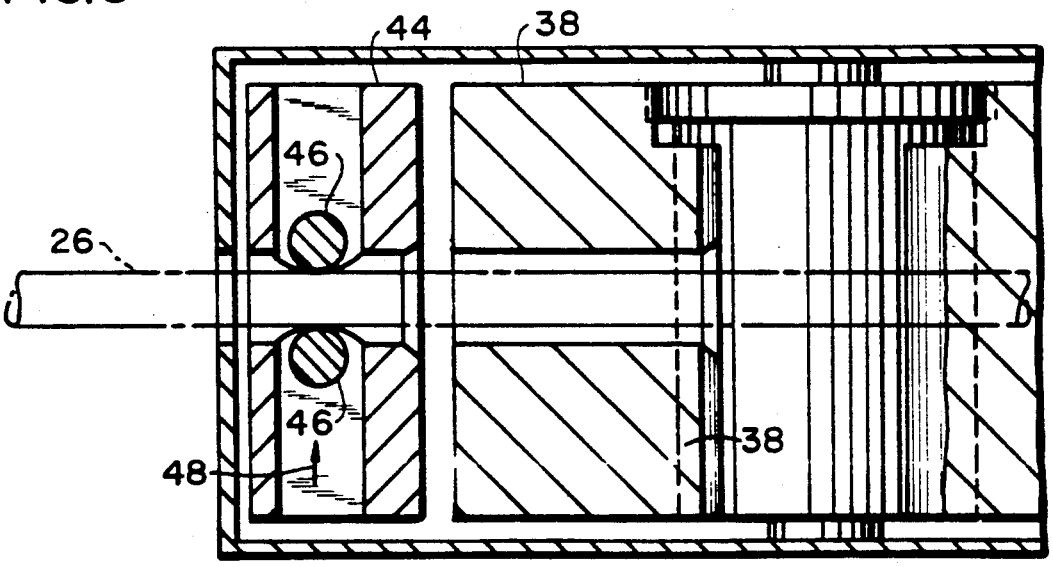
FIG. 6 is a cross-sectional, detailed view of the portion of the drinking straw dispenser shown in FIG. 5.

FIGS. 12–15 show the portion of the dispensing apparatus illustrated in FIGS. 5 and 6 with the addition of a crimping device 104. This crimping device is attached to the front face 50 of the apparatus.

Figure 12:
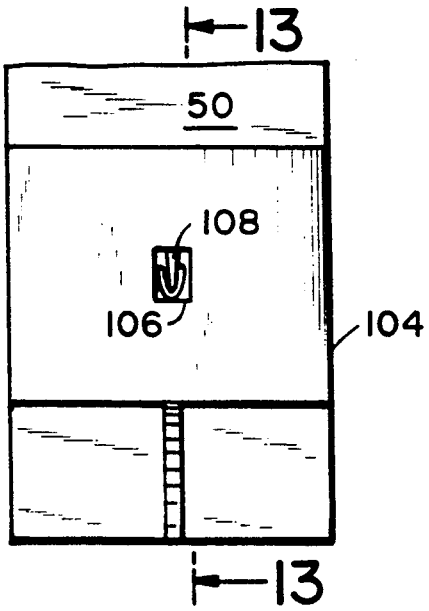
FIG. 12 is an end view of a portion a drinking straw dispenser with an attached crimping device for forming the straw into a swizzle stick.
Figure 13:
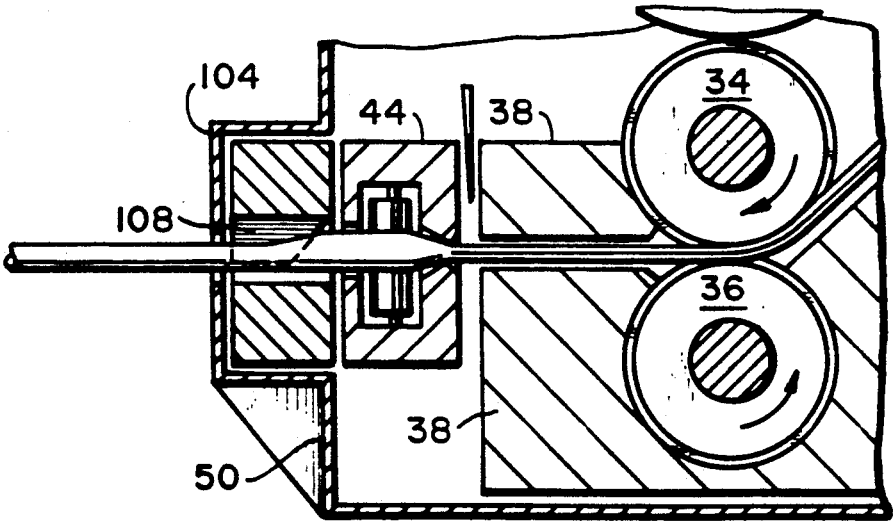
FIG. 13 is a side elevational view of the portion of the drinking straw dispenser shown in FIG. 12.
Figure 14:
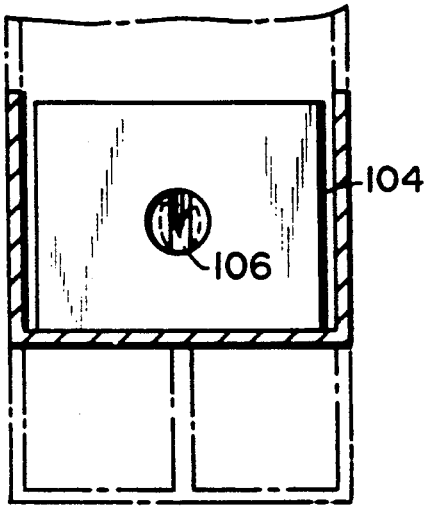
FIG. 14 is an inside elevational view of the crimping device shown in FIG. 12.
Figure 15:
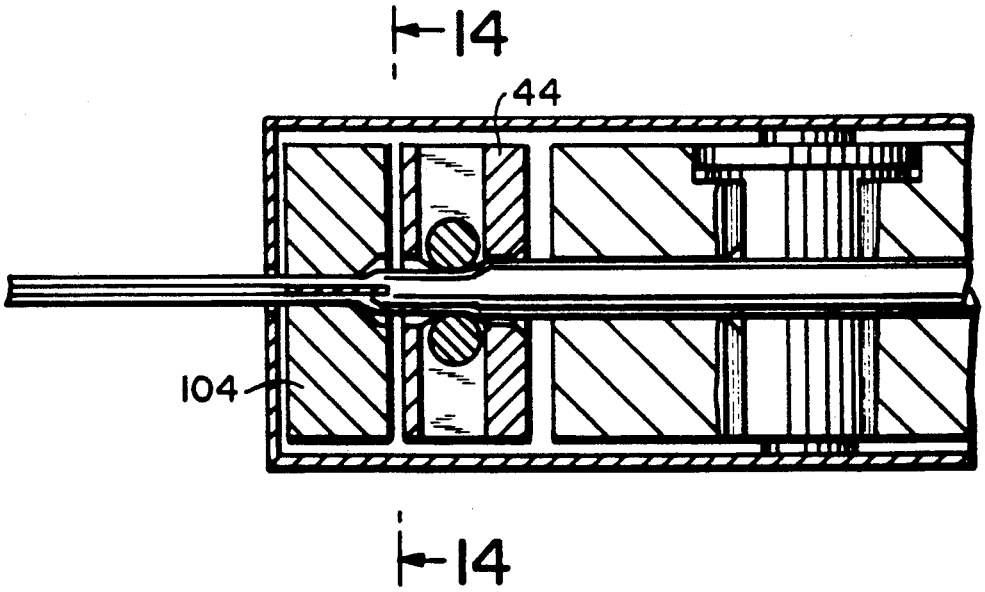
FIG. 15 is a cross-sectional view of the portion of the dispensing device shown in FIG. 13.

As is best seen in FIGS. 12 and 14, the crimping device 104 includes an opening 106 which is round at its entrance and rectangular at its exit. Within the opening is a blade 108 which crimps the hollow tube thus dividing it into two segments and forming the moon shaped cross section.

There has thus been shown and described a novel method and apparatus for dispensing drinking straws, and a drinking straw refill cartridge for use with such method and apparatus, which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are intended to be covered by the claims which follow.

What is claimed is:

1. A method for dispensing drinking straws of a selectable length, on demand, at a local site from a compact source of material, said method comprising the steps of:

(a) providing, at a local site where the drinking straws are to be dispensed, a substantially endless length of substantially flattened flexible tube having a free end;

(b) cutting the free end of said tube to a desired length for a drinking straw;

(c) opening said tube at said free end into a hollow tube;

(d) to form a drinking straw.

2. The method defined in claim 1, wherein said endless tube is provided in the form of a refill unit comprising a substantially endless, substantially flattened flexible tube wound in a substantially spiral form.

3. The method defined in claim 2, wherein said refill unit further comprises a spindle disposed at the center of said spirally wound tube, said spindle providing a rigid, internal support for said wound tube, whereby said tube is unwound from the outside of said spiral form.

4. The method defined in claim 2, wherein said refill unit further comprises a cylindrical sleeve disposed around the outside circumference of said serially wound tube, said sleeve providing a rigid external support for said wound tube, whereby said tube may be unwound from the inside of said spiral form.

5. An apparatus for dispensing drinking straws of a selectable length, on demand, at a local site from a compact source of material, said apparatus comprising in combination:

(a) a dispenser housing adapted to be placed at a local site;

(b) a refill cartridge arranged in said housing and including a substantially endless length of substantially flattened flexible tube having a free end;

(c) means disposed in said housing for cutting the free end of said tube to a desired length for a drinking straw;

(d) means disposed in said housing or opening said tube at said free end into a hollow tube to form a drinking straw.

6. The apparatus defined in claim 5, wherein said refill cartridge comprises said tube wound in substantially spiral form.

7. The apparatus defined in claim 6, wherein said refill cartridge further comprises a spindle disposed at the center of said spirally wound tube, providing a rigid internal support for said wound tube, whereby said tube is unwound from the outside of said spiral form.

8. The apparatus defined in claim 6, wherein said refill cartridge further comprises a cylindrical sleeve disposed around the outside circumference of said spirally wound tube, said sleeve providing a rigid external support for said wound tube, whereby said tube may be unwound from the inside of said spiral form.

9. The apparatus defined in claim 6, further comprising means for reversing the direction of wrap of the flattened straw to remove its curvature as it is unwound from said spiral form in said cartridge.

10. The apparatus defined in claim 5, wherein said opening means includes means for opening said tube into a circular shape in cross section.

11. The apparatus defined in claim 5, wherein said opening means includes means for opening said tube into a rectangular shape in cross section.

12. The apparatus defined in claim 5, wherein said opening means includes means for opening said tube into a moon shape in cross section.

13. The apparatus defined in claim 5, wherein said cutting means includes adjustment means for selecting the length of the drinking straw.

14. The apparatus defined in claim 5, wherein said tube is made of a material which has a tendency to return to its original shape after deformation.

* * * * *